US005261494A

United States Patent [19]

McLoughlin et al.

[11] Patent Number: 5,261,494

[45] Date of Patent: Nov. 16, 1993

[54] FIREFIGHTING NOZZLE

[76] Inventors: John E. McLoughlin, 26 Southern Blvd., Nesconset, N.Y. 11767; Neocles G. Athanasiades, 6 Maybeck Dr., East Setauket, N.Y. 11733

[21] Appl. No.: 731,492

[22] Filed: Jul. 17, 1991

[51] Int. Cl.[5] ..... A62C 31/05

[52] U.S. Cl. ..... 169/70; 239/444; 239/453

[58] Field of Search ..... 169/5, 70; 239/443, 239/444, 452, 453, 558

[56] References Cited

U.S. PATENT DOCUMENTS

| | | | |
|---|---|---|---|
| 556,291 | 3/1896 | Turner | 239/441 |
| 577,616 | 2/1897 | Day | 239/444 |
| 1,398,133 | 11/1921 | Horne | 239/444 X |
| 2,176,699 | 10/1939 | Anderson | 239/444 X |
| 2,218,411 | 10/1940 | Albach et al. | 239/444 X |
| 2,984,418 | 5/1961 | Dickmann et al. | 239/452 X |
| 3,779,318 | 12/1973 | Livingston | 169/70 |

FOREIGN PATENT DOCUMENTS

| | | | |
|---|---|---|---|
| 149421 | 4/1937 | Austria | 239/456 |
| 353593 | 7/1931 | United Kingdom | 169/70 |

*Primary Examiner*—Charles A. Marmor
*Assistant Examiner*—Andrew C. Pike
*Attorney, Agent, or Firm*—Louise S. Heim

[57] ABSTRACT

A firefighting nozzle includes a nozzle body having a having a centrally formed jet orifice at its outlet end. An annular fog spray opening concentrically surrounds the jet orifice. A jet control valve activated by a trigger is provided for allowing selective variation of the diameter of the solid stream emitted from the jet orifice. A fog control valve activated by a twist handle is provided for selectively varying the intensity of the discharge from the fog spray opening. The jet control valve and the fog control valve are operable independently of and simultaneously with one another, so that either a variable diameter solid stream or a variable fog cone, or both, can be produced at once.

18 Claims, 6 Drawing Sheets

FIG. 6
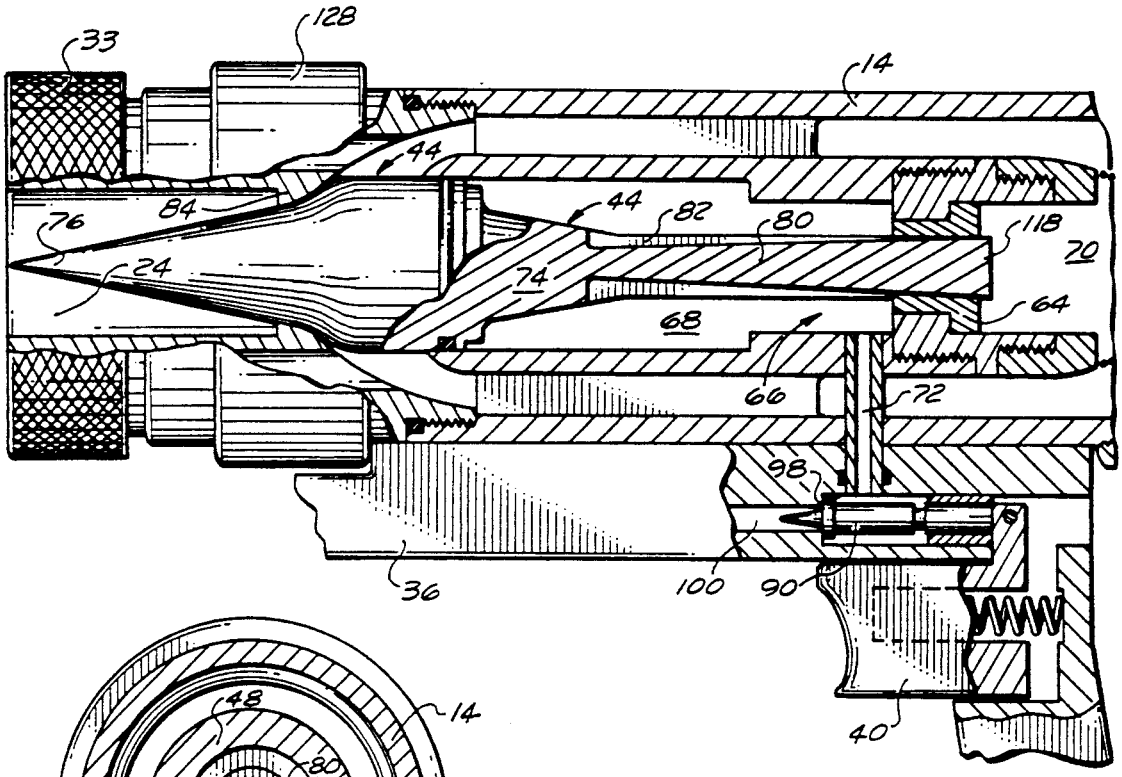
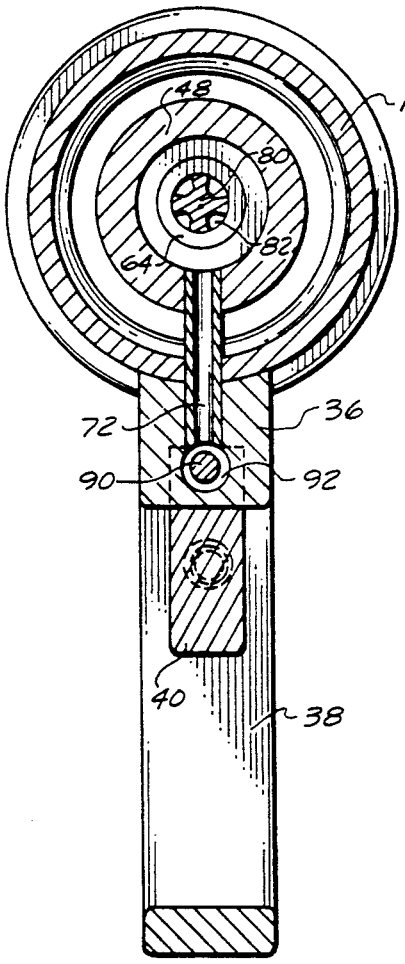
FIG. 7
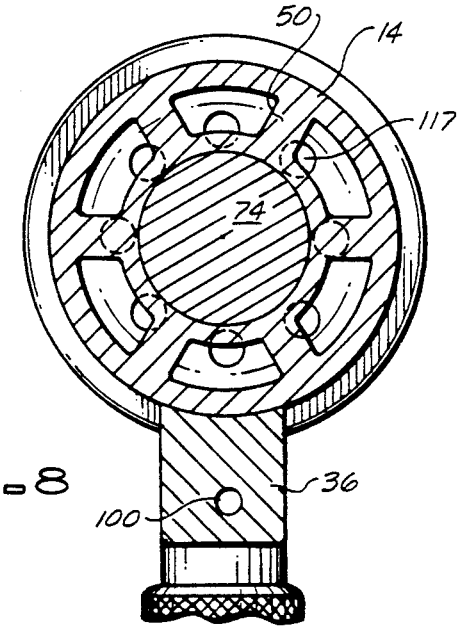
FIG. 8

FIREFIGHTING NOZZLE

BACKGROUND OF THE INVENTION

1. Field of the Invention

This invention relates to the art of firefighting equipment.

More particularly, this invention relates to a spray nozzle for attachment to a fire hose.

In a further and more specific aspect, the instant invention concerns a firefighting nozzle capable of discharging a variable solid stream and a variable fog spray, with controls for each type of spray being operable independently of and simultaneously with one another.

2. Description of the Prior Art

Firefighting nozzles can be broadly classified into two basic types. The oldest and simplest type of nozzle, known as the solid stream or straight tip nozzle, consists essentially of a tapered cone secured to the end of a fire hose, with a quarter-turn ball valve or similar device incorporated into the nozzle opening for controlling the flow of water. A more modern type of nozzle, known as an automatic nozzle, incorporates a spring-biased disc into the discharge opening for maintaining a substantially constant pressure in the nozzle. Each of the foregoing nozzles has its own advantages and disadvantages which makes it more suitable for certain applications than for others.

The primary advantage of the solid stream nozzle, for instance, is that it concentrates the water from the fire hose into a high force, high velocity, circular stream which is extremely effective in "punching through" fires and burning debris to extinguish flames. A drawback of this type of nozzle, however, is that a very high reaction force is generated by the flow when the control valve is fully opened, making the nozzle difficult and sometimes unsafe for a fireman to handle. The reaction force can be decreased by partially closing the control valve, but this creates severe turbulence in the nozzle, which causes the quality of the stream to deteriorate, and reduces the reach of the stream.

Still another problem encountered with the solid stream nozzles is that tips of various exit orifice diameter must be attached to the nozzle, depending on the available water pressure, water volume, and the number of firefighters available to handle the hose. The necessity to change tips is inconvenient and can cause dangerous delays in responding to a fire.

As a result of the above drawbacks of solid stream nozzles, the automatic nozzle has become more widely used in the United States. One key advantage of the automatic nozzle is that the constant pressure feature allows for a constant reach of the water stream regardless of pressure oscillations at the source. In addition, the automatic nozzle easily incorporates a feature known as "fog generation", which allows the nozzle to emit a conical spray of evenly distributed water droplets. This is done by forming a number of inwardly and forwardly projecting rods or teeth along the inner circumference of the discharge orifice. These teeth cause the water to variably change direction and to be emitted in all directions of the included solid angle of a cone. The resultant fog is highly desirable, since it spreads over a relative wide area, forming a protective shroud cooling the flames in the immediate vicinity of the firefighter. The advantages of this type of nozzle are somewhat diminished, however, by its inability to produce the same type of highly concentrated, forceful stream which is available in a solid stream nozzle for punching through burning debris.

A third type of nozzle, known as the Navy nozzle, consists of a straight tip nozzle and a fog-generating nozzle, provided one above the other. A diverter valve allows the operator to choose which nozzle to use. Even this arrangement is not entirely satisfactory, however, since only one option is available at a time, and the choice of which type of stream to use in a given situation is not always a clear-cut or easy one.

It would be highly advantageous, therefore, to remedy the foregoing and other deficiencies inherent in the prior art.

Accordingly, it is an object of the present invention to provide a firefighting nozzle capable of producing a solid stream and a fog spray simultaneously.

Another object of the invention is the provision of a nozzle having two orifices for producing different types of spray, and independently operable valves for controlling the flow through each orifice.

And another object of the invention is to provide a firefighting nozzle having a valve for varying the diameter of a solid stream, eliminating the need for different sized tips.

Still another object of the invention is the provision of hydraulically-controlled valves for varying the discharge from a firefighting nozzle.

Yet another object of the invention is to provide a firefighting nozzle with conveniently located fingertip controls which allow the operator to keep both hands on the nozzle at all times.

Yet still another object of the invention is the provision of a firefighting nozzle with a trigger-actuated control for producing a variable-diameter solid stream, wherein the solid stream shuts off automatically when the trigger is released.

And a further object of the invention is to provide a firefighting nozzle with a twist-actuated fog spray valve which remains open if the nozzle is dropped.

And still a further object of the invention is to provide a firefighting nozzle with fog-generating capability and a shaper ring for continuously varying the included angle of the fog cone.

And yet a further object of the invention is to provide a firefighting nozzle with means for controlling the reaction force generated by the nozzle.

And still a further object of the invention is the provision of a firefighting nozzle, according to the foregoing, which is relatively inexpensive to manufacture and comparatively simple and easy to use.

SUMMARY OF THE INVENTION

Briefly, to achieve the desired objects of the instant invention in accordance with the preferred embodiment thereof, a firefighting nozzle is provided with independently variable solid stream and fog spray capability. The nozzle comprises a hollow body having a centrally formed jet orifice at its outlet end. A annular fog spray opening concentrically surrounds the jet orifice. A jet control valve is provided in the jet orifice for allowing selective variation of the diameter of the solid stream discharged from the orifice. A fog control valve is provided in the fog spray opening for selectively varying the intensity of the flow through the opening. In addition, a shaper ring is provided for selectively varying the included angle of the fog cone.

In a preferred embodiment of the invention, the jet control valve consists of a valve body mounted for longitudinal movement toward and away from a valve seat provided near the outlet end of the nozzle. The rear portion of the valve body extends into a hydraulic chamber having an inlet and an outlet. A needle valve controls flow through the outlet of the hydraulic chamber, thus controlling the amount of pressure exerted on the valve body. The needle valve is actuated by a manually controlled trigger movably connected to a rear grip depending from the nozzle body. The distance from the jet valve body to the valve seat, and thus the diameter of the discharged solid stream and the resulting reaction force, is dependent on the force exerted on the trigger.

The fog control valve comprises an annular valve body mounted for reciprocation toward a valve seat defining the inner circumference of the annular fog spray opening The rear portion of this valve body also extends into a hydraulic chamber having an inlet and an outlet. The outlet is controlled by a twist-actuated metering valve mounted in a front grip depending from the nozzle body. The fog valve is opened an amount proportional to the amount of twist on the metering valve. The metering valve retains its position even if the nozzle is dropped, so that a protective spray is always available for protecting the firefighters. In addition, for safety reasons, the shaper ring is mounted such that it returns to its widest spray position when its control lever is released, so that reaction forces are minimal

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which:

FIG. 6 is a view similar to FIG. 5, with the jet control valve fully closed;

FIG. 7 is a cross-sectional view taken through line 7—7 of FIG. 6;

FIG. 8 is a cross-sectional view taken through line 8—8 of FIG. 6;

DETAILED DESCRIPTION OF THE PREFERRED EMBODIMENTS

Figure 1:
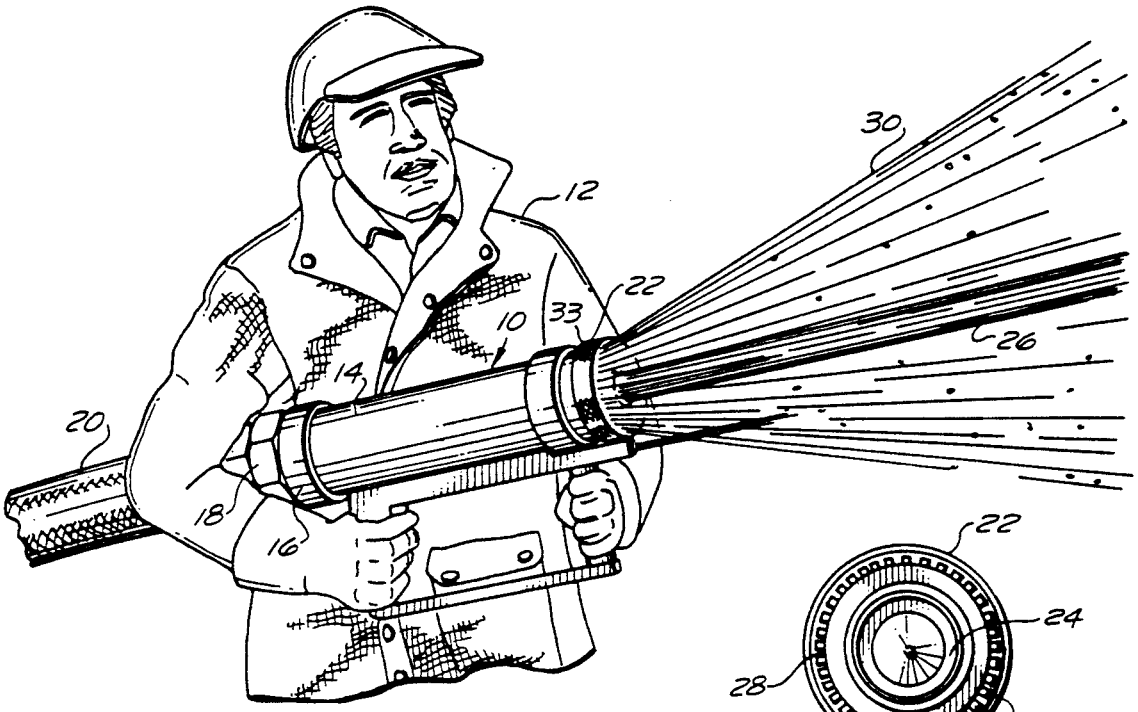
FIG. 1 is a perspective view showing a firefighter operating a nozzle according to the instant invention.
Figure 3:
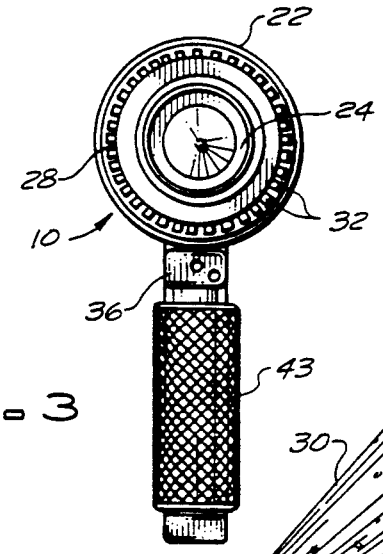
FIG. 3 is a front view of the nozzle.
Figure 2:
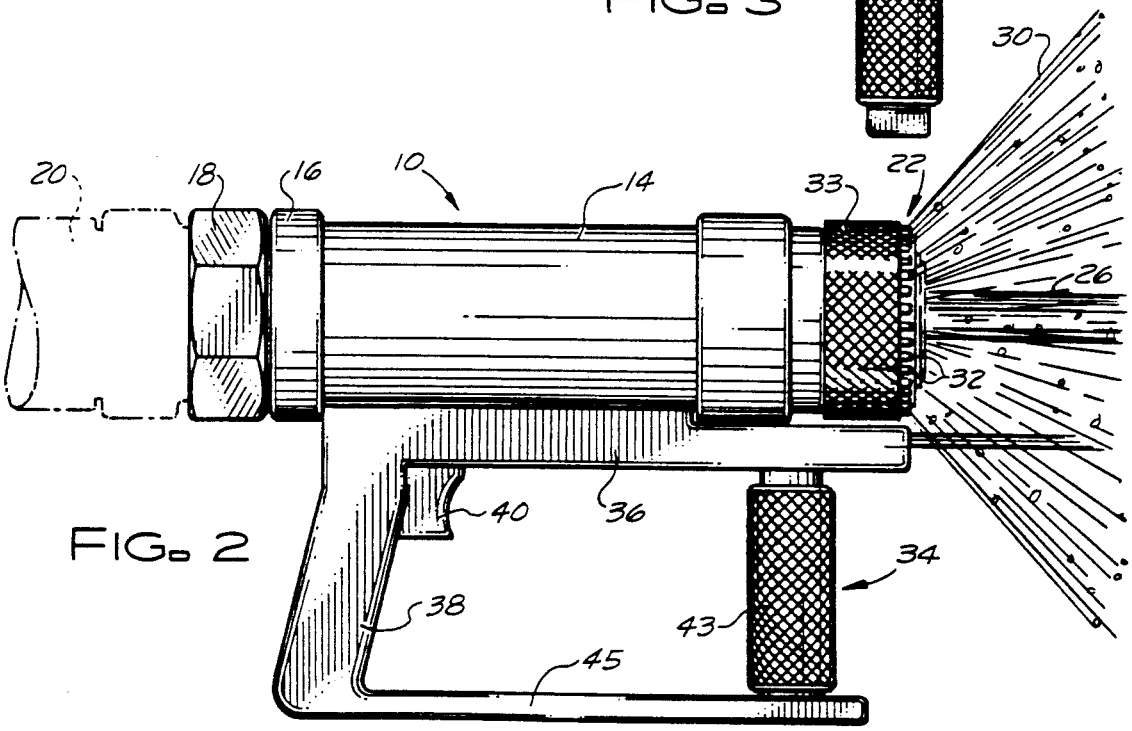
FIG. 2 is a side view showing the nozzle of FIG. 1.

Turning now to the drawings in which like reference characters indicate corresponding elements throughout the several views, attention is first directed to FIG. 1, which shows the nozzle according to the present invention, indicated in its entirety by the numeral 10, being manipulated by a firefighter 12. With further reference to FIGS. 2 and 3, the nozzle 10 comprises a generally cylindrical nozzle body or outer housing 14 having an inlet end 16 secured by a swivel coupling 18 to a conventional fire hose 20. The outlet end 22 of the nozzle body 14 defines a central jet orifice 24 for discharging a circular, solid stream 26 of liquid. The jet orifice 24 is concentrically surrounded by an annular fog spray opening 28 for discharging a conical spray or fog 30, made up of liquid droplets which are evenly distributed throughout the cone. The droplets are produced by a plurality of inwardly curved, forwardly projecting teeth 32 formed along the circumference of the fog spray opening 28. A shaper ring 33 is moveably mounted at the outlet end 22 of the nozzle body 14, for allowing adjustment of the included angle of the fog cone 30.

A specially configured gripping assembly 34 is provided on the underside of the nozzle body 14. The gripping assembly 34 includes an upper support bar 36, a rear pistol grip 38 having a manually actuable trigger 40, and a front grip 42 having a twist actuator 43 with a knurled outer surface. A lower guard bar 45 extends between rear grip 38 and front grip 42, preventing the hose 20 or other object from becoming entangled in the gripping assembly and accidentally depressing the trigger 40. The function and structure of trigger 40 and twist actuator 43 will be described shortly.

Figure 4:
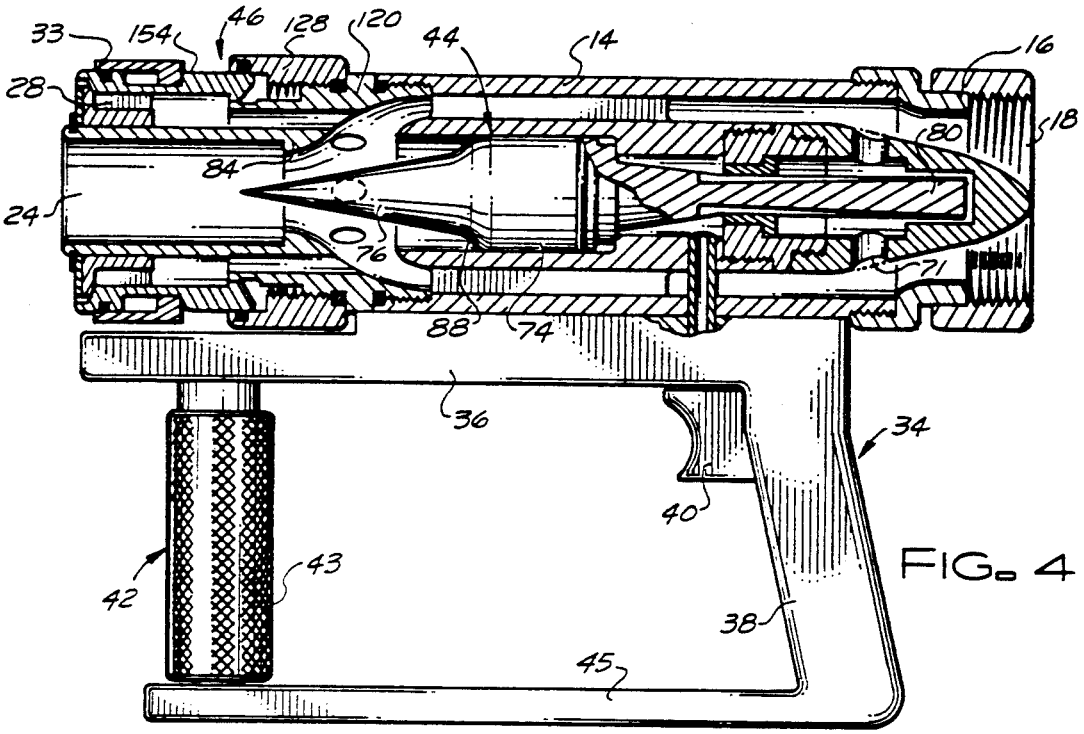
FIG. 4 is a longitudinal sectional view of the nozzle, with details of the handle and controls eliminated for purposes of clarity.

Turning now to FIG. 4, a jet control valve 44 is provided for controlling the discharge of liquid through the jet orifice 24. Specifically, the jet control valve 44 allows the diameter of the circular solid stream 26 to be selectively varied In addition, a fog control valve 46 is provided for controlling the discharge of liquid through the annular fog spray opening 28. The jet control valve 44 and fog control valve 46 are operable both simultaneously with and independently of one another.

The structure and operation of the jet control valve 44 can be best understood by referring to FIGS. 5–9. As can be seen most clearly in FIG. 9, the jet control valve 44 includes an interior valve housing 48, which is located in spaced relationship to the inner sidewall of the outer housing 14 by a plurality of radially extending straightening vanes 50. For ease of manufacturing, the interior valve housing 48 is preferably constructed as a three-piece body, including a generally tubular front member 52 having an open front end 54 and an internally threaded, open back end 56; a rear member 57 having an internally threaded open, front end 58 and a closed back end 60; and a generally tubular, central connector member 62 having both ends externally threaded for cooperation with the corresponding internally threaded ends of the front and rear members 56, 57. A sleeve bearing 64 is carried in the bore of the connector member 62.

Figure 5:
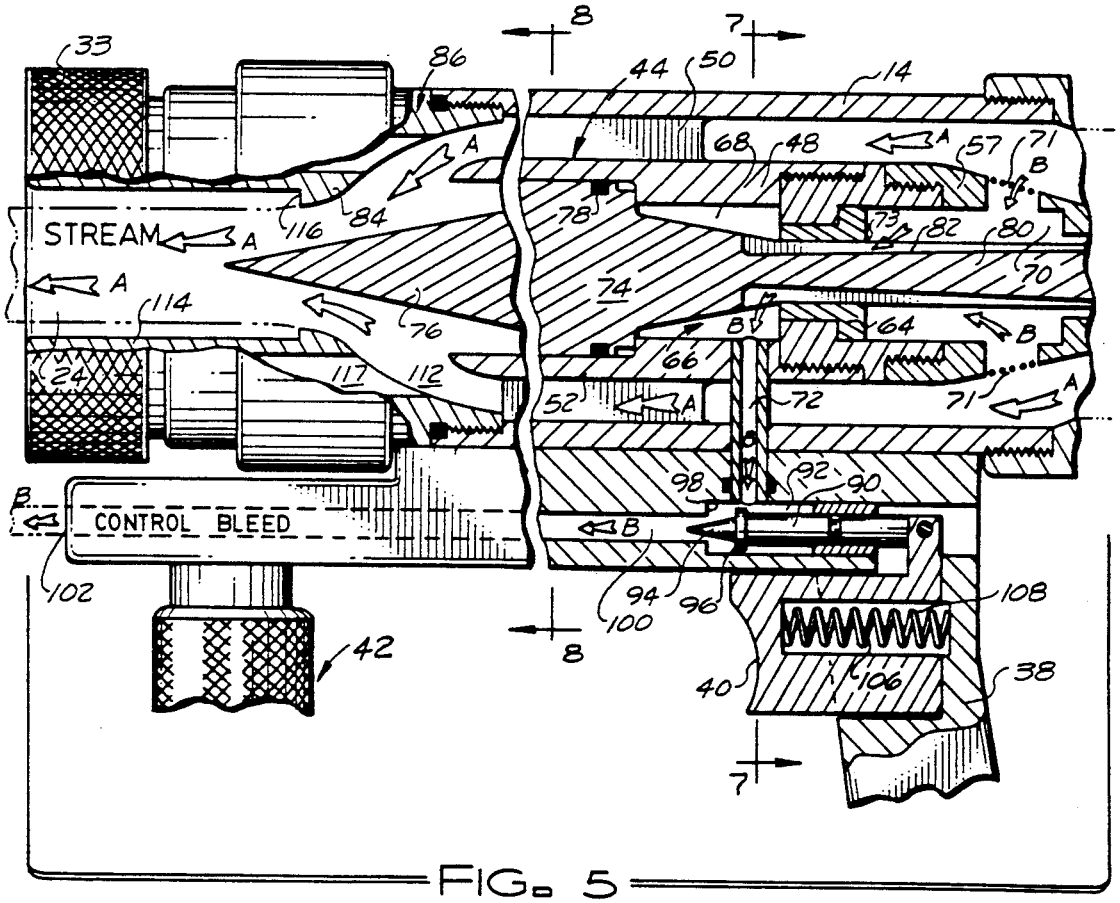
FIG. 5 is an enlarged fragmentary sectional view showing the rear portion of the nozzle, with the jet control valve fully opened.
Figure 9:
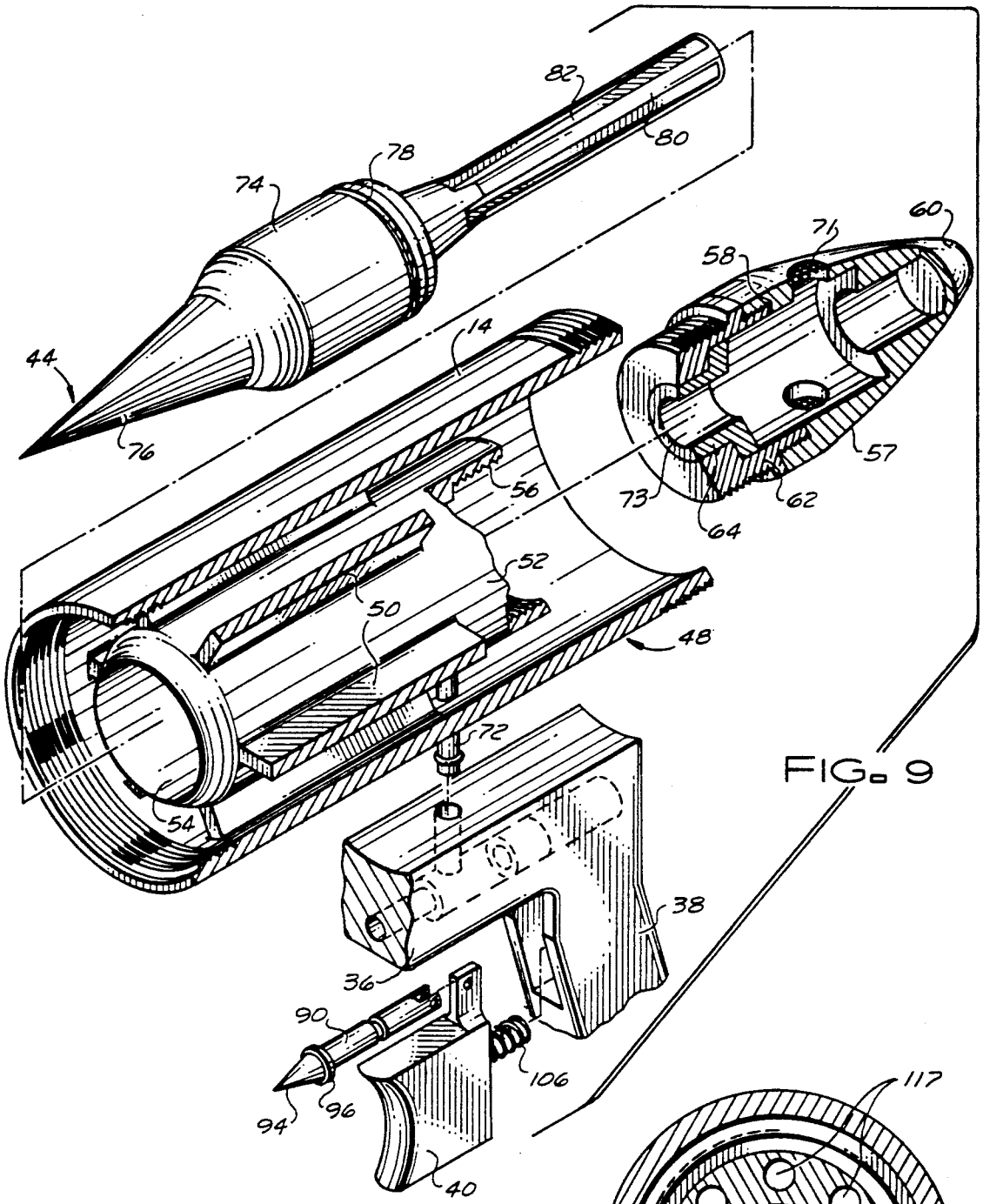
FIG. 9 is an exploded perspective view showing the components of the jet control valve and its associated controls.
Figure 13:
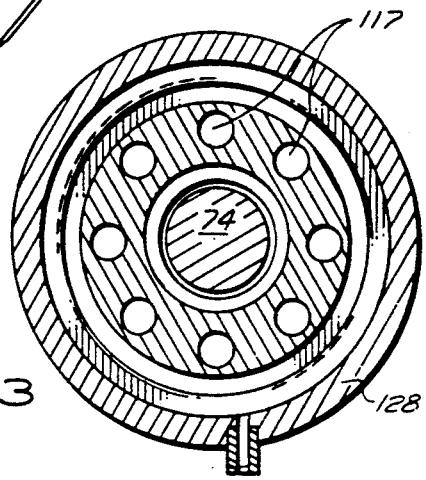
FIG. 13 is a cross-sectional view taken through line 13—13 of FIG. 10.

With additional reference to FIG. 5, the interior valve housing 48 defines a hydraulic chamber 66, consisting of a front chamber 68 carried in the front member 52 and a rear chamber 70 carried in the rear member 57. A plurality of circumferentially spaced apart, meshed covered openings 71 formed in the sidewall of the rear member 67 serve as inlets for admitting filtered liquid into the rear chamber 70. An outlet passage 72 extending through the sidewall of the front member 52 discharges liquid from the front chamber 68. The bore 73 of the sleeve bearing 64 defines a flow passage connecting the two chambers 68, 70.

A valve body 74 having a forwardly tapered front end 76 is mounted for longitudinal translation within the hydraulic chamber 66. A sealing ring 78 carried on an intermediate portion of the valve body 74 prevents liquid in the hydraulic chamber 66 from escaping past the front end 76. In addition, the valve body 74 includes an elongated tail portion 80 which extends rearwardly through the sleeve bearing 64. A plurality of longitudinally extending grooves 82 are machined or otherwise formed in the tail portion 80. The depth of the grooves 82 increases toward the front of tail portion 80.

An annular valve seat 84 is formed forwardly of the valve body 74. The valve seat 84 is formed along the rear inner surface of a specially configured tip assembly 86, which will be described in greater detail shortly, in connection with the fog control valve 46. The surface of the valve seat 84 is preferably tapered or contoured to match the taper or contour of the base portion 88 of the conical front end 76 of the valve body 74, so that a tight seal is formed when the valve body 74 is in its full forward position, as shown in FIG. 6.

The movement of the valve body 74 relative to the valve seat 84 is controlled by varying the pressure in the front chamber 68 of the hydraulic chamber 66. This pressure is controlled by a needle-type metering valve 90, which is mounted for longitudinal reciprocation in a control passage 92 communicating with the outlet passage 72 from the front chamber 66. The control passage 92 comprises a chamber formed in the upper support bar 36 of the nozzle grip assembly 34, extending perpendicular to the outlet passage 72.

The needle valve 90 includes a suitably shaped front end 94, the base 96 of which resides against an annular valve seat 98 at the forward end of the control passage 92, when the valve 90 is in its fully forward position. As the valve 90 moves back, away from the valve seat 98, liquid in the control passage 92 is allowed to escape past the front end 94 of the needle valve 90, into a relief duct 100 extending longitudinally through the support bar 36. Liquid in the relief duct 100 exits as a forwardly directed stream through an outlet 102 formed in the front end of the support bar 36.

The needle valve 90 is mechanically coupled to a trigger 40 moveably mounted in the rear grip 38. The trigger 104 is biased to a full forward position by a spring 106 having one end secured to the grip 38 and another end carried in a cavity 108 formed in the trigger 40. Thus, the trigger automatically returns to the forward position when released, forcing the needle valve 90 against the valve seat 98, and shutting off the flow from the jet stream orifice 24. This is an important safety feature, since the high reaction forces generated by the jet stream could cause the hose 20 to whip around dangerously, injuring firefighters, if the jet stream valve 44 were to remain open if the nozzle 10 was dropped.

FIG. 5 illustrates the flow of liquid through the nozzle 10 when the trigger 40 is in its completely retracted position, fully opening needle valve 90 and jet control valve 44. Pressurized liquid enters through the inlet end 16 of the nozzle 10 and flows around the interior valve housing 48 and past the straightening vanes 50, as indicated by arrows A. The liquid then enters the tip assembly 86 through a smooth-walled flow passage 112 which continuously diminishes in area in the forward direction, slowly accelerating the flow to produce a more stable liquid jet. From the flow passages 112, some of the liquid enters an outlet tube 114. The flow passages 112 form a sharp corner 116 with the outlet tube 114, allowing the liquid to make a "clean break". Any liquid not entering the outlet tube 114 flows into the fog spray opening 28 via a plurality of circumferentially spaced apart openings 117 formed in the wall of the flow passage 112, as will be described shortly.

In addition to the liquid flowing around the interior housing 48, a small amount of liquid enters the hydraulic chamber 66 through openings 71 in the rear chamber 70, as shown by Arrows B. The liquid travels from rear chamber 70 to the front chamber 68 via the grooves 82 in the tail portion 80 of the valve body 74, which allow maximum flow through the sleeve bearing 64 when the valve body 74 is fully aft. From the front chamber 68, the liquid enters the outlet passage 72, passes around the front end 94 of the shaped needle valve 90 into the relief duct 100, finally exiting through the outlet 102. Because of the continuous discharge of liquid through the outlet passage 72 and relief duct 102, the pressure in the hydraulic chamber 66 is always minimum, allowing the jet control valve body 74 to remain fully aft until the trigger 40 is released.

FIG. 6 illustrates the valve configuration when the trigger 40 is released, closing the needle valve 90 and the jet control valve 44. In this configuration, the needle valve 90 resides against the valve seat 98, shutting off the flow from the outlet passage 72 to the relief duct 100. As a result, the pressure in the front chamber 68 of the hydraulic chamber increases, forcing the valve body 74 forwardly until the base portion of the tapered front end 76 sealingly engages the valve seat 84, cutting off flow to the outlet tube 114. In addition, when the valve body 74 is in its fully forward position, the rear end 118 of the tail 80 allows minimum leakage into the hydraulic chamber, maintaining the valve body 74 in its forward position.

Although not specifically illustrated, it will be clear to the skilled practitioner that the trigger 40 may be held in any position intermediate the two extremes shown in FIGS. 5 and 6. As the trigger 40 is retracted, the valve body 74 moves away from the valve seat 84 by an amount proportional to the pull on the trigger, thus increasing the area between the front end 76 of the valve and the valve seat 84, resulting in a jet of greater diameter. Since the reaction force generated by the stream varies in proportion to its size for a given pressure, the nozzle operator is able to simply and quickly adjust this force to its safest, most effective level merely by varying the pull on the trigger.

Figure 10:
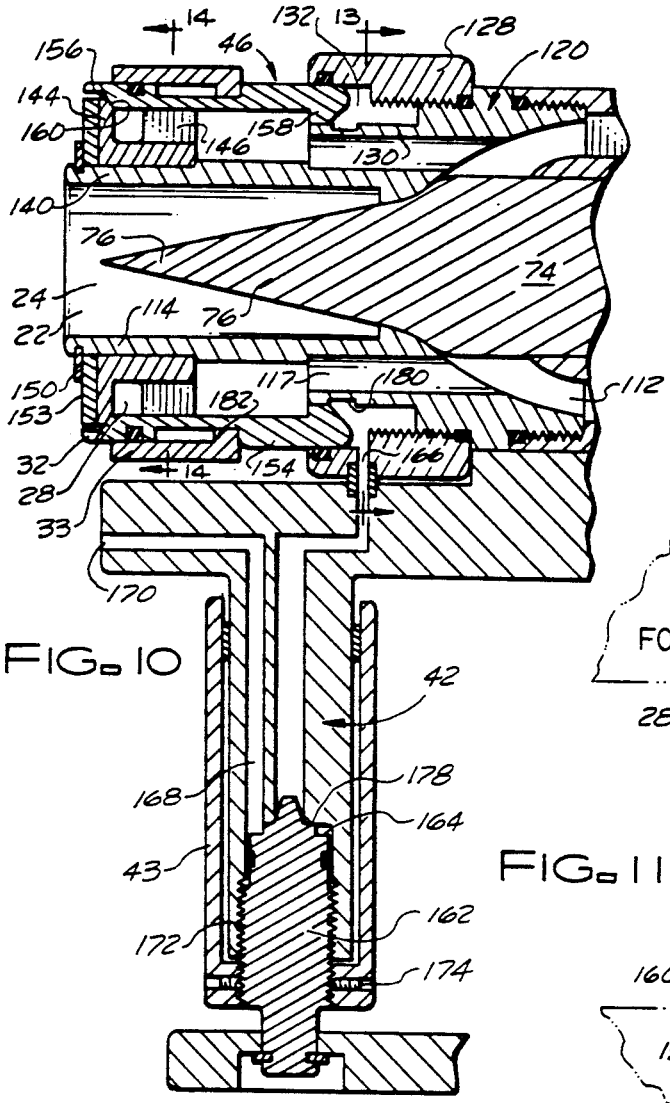
FIG. 10 is a an enlarged fragmentary longitudinal cross-section, showing the front portion of the nozzle, with both the jet control valve and the fog control valve fully closed.
Figure 14:
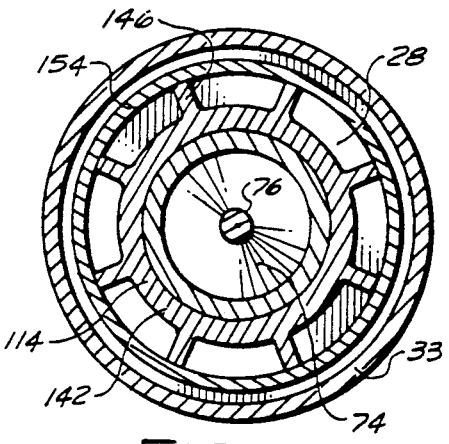
FIG. 14 is a cross-sectional view taken through line 14—14 of FIG. 10.
Figure 15:
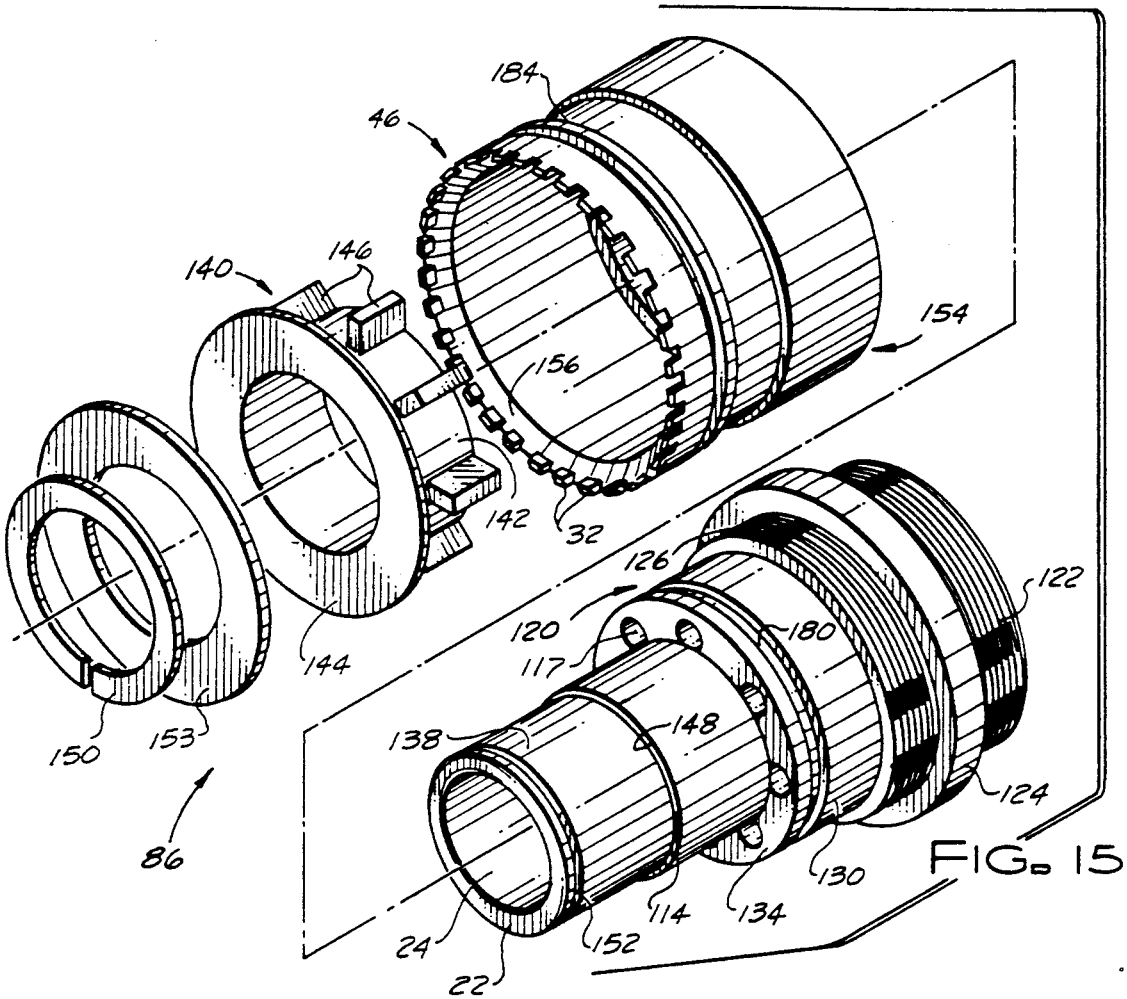
FIG. 15 is an exploded perspective view showing the front portion of the nozzle body and the fog control valve, with the housing nut and shaper ring omitted for purposes of clarity.

Flow downstream of the jet control valve 44 may be best understood by referring to FIG. 15, which shows the components of the tip assembly 86, and also to the longitudinal cross-sections in FIGS. 4 and 10. The tip assembly 86 includes a generally cylindrical main body 120 having an externally threaded rear end 122 for attachment to the front end of the nozzle body 14. A radially extending flange 124 separates threaded end 122 from a second externally threaded portion 126, on which an internally threaded housing nut 128 is mounted. The outer diameter of the main body 120 is reduced forwardly of the threaded portion 126 to form a boss 130. A hydraulic chamber 132 is defined between the boss 130 and the inner surface of the housing nut 128.

The outer diameter of the main body 120 is reduced still further forwardly of the boss 130, forming outlet tube 114. The front end of the boss 130 extends perpendicularly to the outlet tube 114, forming an annular end wall 134. A plurality of bores or openings 117 extend longitudinally from the annular end wall 134 to the rear inner surface of the main body 120, where they intersect with the flow passages 112 described earlier, in connection with FIG. 5.

The outer surface of the outlet tube 114 is stepped slightly inwardly at a location halfway between annular wall 134 and the outlet end 22 to form a reduced diameter front portion 138 on which a spacer ring 140 is mounted. The spacer ring 140 comprises an annular body 142 having a flange 144 extending radially outwardly from its forward end. A plurality of positioning vanes 146 extend radially outwardly from and longitudinally along the annular body 142. The spacer ring 140 is clamped against the step 148 in the outlet tube 114 by a split retaining ring 150 carried in a groove 152 formed at the outlet end 22 of the tube 114. An O-ring 153 is interposed between the spacer ring 140 and the retaining ring 150.

An annular valve body 154 is supported by the positioning vanes 146, and mounted for longitudinal movement along the outer surface of the outlet tube 114. The space between the valve body 154 and the outlet tube 114 defines the annular fog spray opening 28. The front end of the valve body 154 comprises a tapered surface 156 which terminates in forwardly projecting teeth 32. The rear end of the valve body 154 includes an inwardly projecting flange 158 which extends into the hydraulic chamber 132. When the valve body 154 is in its fully forward position, as shown in FIG. 10, the bottom edge of the flange 158 engages the outer surface of the boss 130, minimizing flow between the fog spray opening 20 and the hydraulic chamber 132. At the same time, the tapered front surface 156 of the valve body engages the rear outer surface of the spacer ring 140, which functions as a valve seat 160. Together, the annular valve body 154 and the valve seat 160 are the primary components of the fog control valve 46.

The operation of the fog control valve 46 is generally similar to the operation of the jet control valve 44. That is, the movement of the valve body 154 is controlled by varying the pressure in the hydraulic chamber 132. The pressure in the chamber 132 is controlled by a metering valve 162 mounted in a control passage 164 formed in the front grip 42 of the grip assembly 34. The control passage 164 communicates with both an outlet passage 166 extending from the hydraulic chamber 132 and a bleed passage 168 extending through the front grip 42 and the upper support bar 36. The bleed passage 168 terminates in an outlet 170, which allows water to exit as a forwardly directed stream.

In contrast to the needle valve 90 governing the jet control valve 44, which is mounted solely for longitudinal movement, the metering valve 162 for the fog valve 46 is rotatably mounted, and is retained within the front grip 42 by screw threads 172. The valve 162 is secured by set screws 174 to a twist actuator 43 mounted for rotation about the front grip 42. The screw threads 172 convert the twisting movement of the actuator to a longitudinal movement of the metering valve 162 toward or away from its seat 178. In addition, the screw threads 172 retain the valve 172 in its most recent position when the actuator 43 is released. Thus, the control valve 46 can be remain open even when the nozzle 10 is dropped, so that the protective, cooling effects of the fog spray are not lost.

Figure 11:
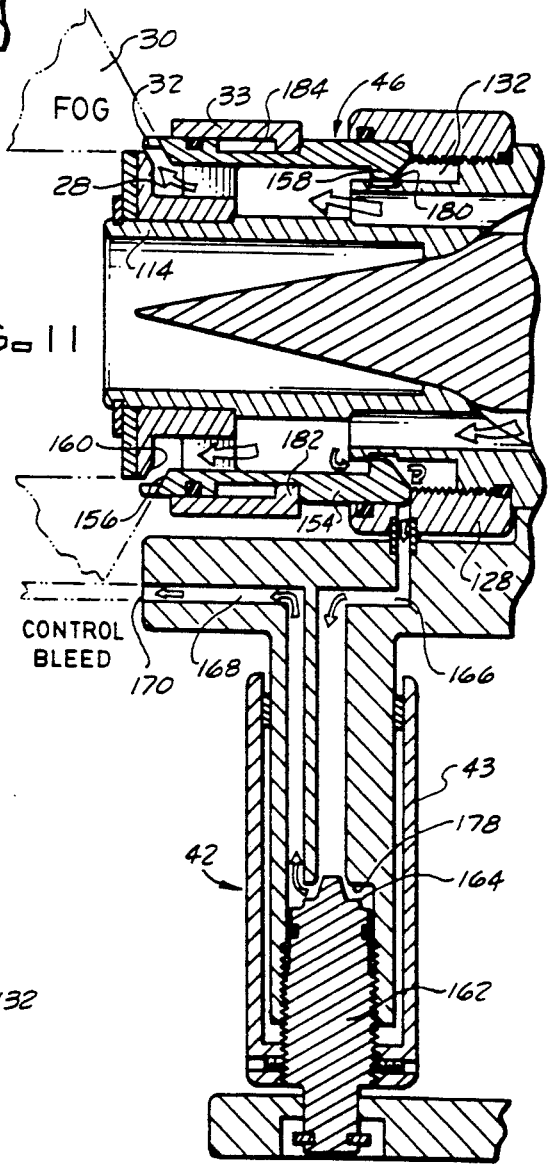
FIG. 11 is a view similar to FIG. 10, with the jet control valve closed, the fog control valve fully opened, and the shaper ring fully aft.

Operation of the fog control valve 46 may be understood by referring to FIGS. 10 and 11. When the valve is fully closed, as shown in FIG. 10, liquid entering the annular flow opening 28 through the bores 117 in the tip assembly 86 exerts a rearward pressure on the rear flange 158 of the valve body 154. This pressure is counteracted by forward pressure in the hydraulic chamber 132, causing the valve 46 to remain closed. However, as soon as the twist actuator 43 is rotated, causing the metering valve 162 to move away from its seat 178, the pressure in the hydraulic chamber 132 decreases, allowing the valve body 154 to move rearwardly. As the valve body 154 moves rearwardly, its rear flange 158 passes over a groove 180 formed in the front end of the boss 130 projecting from the main body 120. The clearance between the bottom edge of the flange 158 and the bottom wall of the groove 180 allows more liquid to flow into the hydraulic chamber 132, and then out again through the outlet passage 166 and bleed passage 168. At the same time, the tapered front surface 156 of the valve body 154 moves away from the valve seat 160 allowing liquid to exit from the fog orifice 28. Fluid exiting through the orifice 28 impinges on the forwardly directed teeth 32, which direct the flow in all directions, creating a conical "fog" 30 of evenly distributed droplets.

The included angle of the fog cone 30 may be selectively varied by manipulation of the shaper ring 33, which consists of an annular member having an inwardly extending flange 182 formed at its rear end. The flange 182 is disposed for sliding movement in a recess extending annularly around the valve body 154. Although not specifically illustrated, a control ring or lever may be provided on the shaper ring for allowing manual control of the shaper ring's movement. Such a ring or lever preferably depends from the underside of the shaper ring 33 and is readily accessible from the front grip 42, so that an operator can grasp it with a thumb or other finger, without removing his hand from the twist actuator 174.

Figure 12:
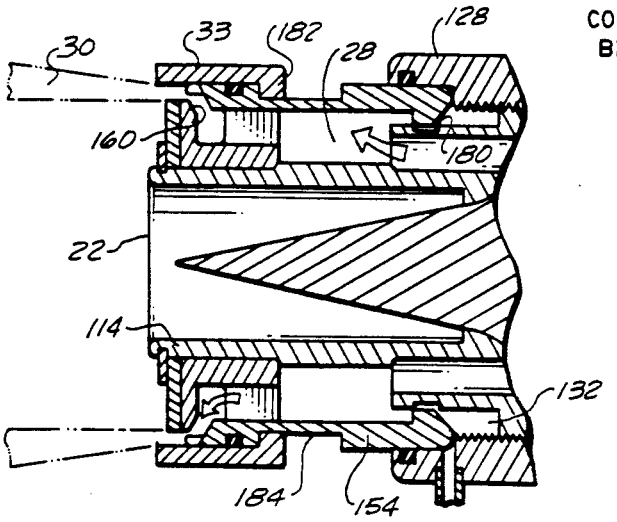
FIG. 12 is a view similar to FIG. 11, with the jet control valve closed, the fog control valve fully opened, and the shaper ring fully forward.

FIG. 11 shows the shaper ring 33 in its fully aft position, which results in the widest possible fog cone angle FIG. 12 shows the shaper ring 33 in its fully forward position. In this position, the front end of the ring 33 projects forwardly, beyond the valve seat 160 and the front end 22 of the nozzle, thus forming a ceiling which narrows the fog cone to its minimum included angle. Other than this, the flow of liquid in FIG. 12 is exactly the same as in FIG. 11. The shaper ring 33 is mounted on the valve body 154 in such a way that the reaction forces created by the exiting liquid automatically force the ring 33 to the fully aft position shown FIG. 11 when the control lever is released, since the widest angle cone is safest.

Although FIGS. 10–12 show the fog valve 46 only in its fully open and fully closed position, and the shaper ring 33 fully forward and fully aft, it will be evident that both the fog valve 46 and the shaper ring 33 can be independently maintained in any position intermediate these extremes. It will also be evident that, although FIGS. 10–12 show the jet control valve 44 fully closed, the fog control valve 46 and shaper ring 33 can also be operated when the jet control valve 44 is fully open, or in an intermediate position. The state of the fog control valve 46 is not in any way dependent on the state of the jet control valve, and vice versa. Thus, an infinitely variable combination of discharge patterns is obtainable.

Figure 16:
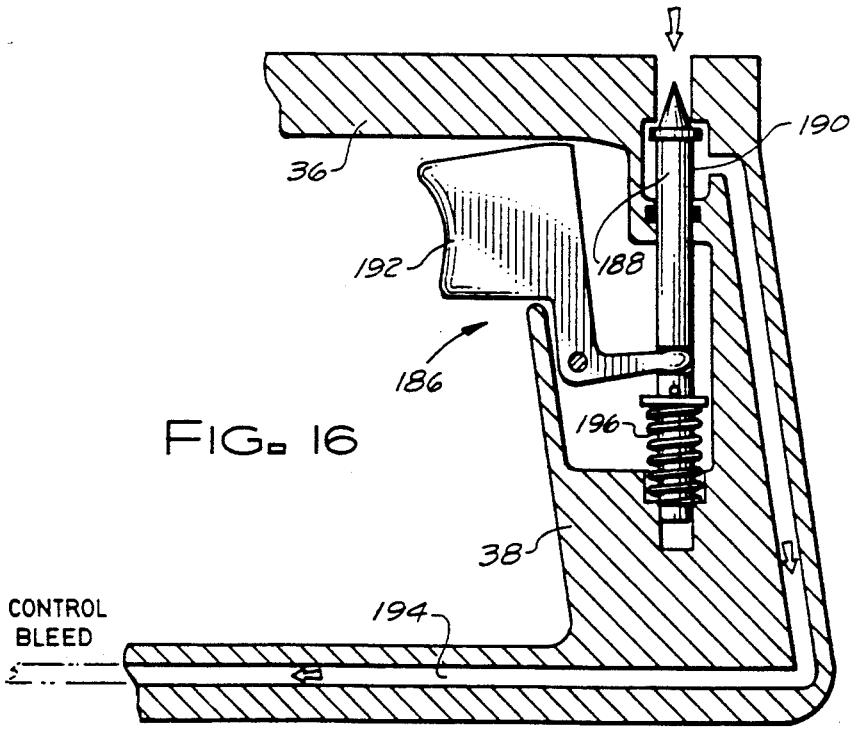
FIG. 16 is a fragmentary longitudinal cross-sectional view showing alternate actuation means for the jet spray control valve.

A modification of the actuator for the jet control valve 44 is illustrated in FIG. 16. The operating principles behind the modified actuator 186 are the same as in the actuator of FIG. 5, except that the needle valve 188 and its control chamber 190 are coaxial with, rather than perpendicular to, the outlet passage 72, and the trigger 192 is mounted for pivoting movement in the rear grip 38. In addition, the relief duct 194 extends longitudinally through the bottom guard bar 44, rather than the top support bar 36. As in previous embodiment, however, the needle valve 188 is biased by a spring 196 toward the closed position, so that the jet valve closes automatically when the trigger 192 is released.

Other modifications to the invention will also be apparent. For instance, for remote applications, both the trigger actuator 40 or 192 and the twist actuator 176 may be operated by solenoids, rather than manually. Alternatively, the needle valve 90 or 188 and the twist valve 162 could themselves be replaced by tubes leading to valves located at a remote operator's station. The remote valves may be solenoids or any other type of valve. If solenoid valves are used they may be pulsed open or closed at varying rates to allow a particular average flow through the relief ducts 100 or 194 and 168, causing the corresponding valves 44 and 46 to maintain a particular position. In addition, the fog spray valve 46 could be threaded onto the main body 130 of the tip assembly 86, and controlled by manual rotation rather than hydraulically. To the extent that such variations and modifications do not depart from the spirit of the invention, they are intended to be included within the scope thereof which is assessed only by a fair interpretation of the following claims.

Having fully described and disclosed the instant invention and alternately preferred embodiments thereof in such clear and concise terms as to enable those skilled in the art to understand and practice the same, the invention claimed is.

We claim:

1. A firefighting nozzle comprising a hollow nozzle body having:

a) an open inlet end for receiving a liquid from a hose, b) an outlet end including i) a jet orifice for discharging a first portion of said liquid in a form of a circular solid stream having a variable diameter, and ii) an annular fog spray opening surrounding said jet orifice for discharging a second portion of said liquid in a form of a conical stream of evenly distributed droplets, said conical stream having an intensity and an included angle, and c) jet control means disposed within said jet orifice for selectively varying said diameter, said jet control means including i) a valve body mounted for longitudinal movement within said nozzle body, said valve body having a tapered front end, ii) a valve seat formed in said jet orifice forwardly of said valve body, said valve seat including an inner surface tapered to mate with said front end of said valve body, and iii) hydraulic control means utilizing hydraulic pressure for moving said valve body relative said valve seat to vary said diameter.

2. A firefighting nozzle according to claim 1, further comprising a plurality of inwardly and forwardly extending projections provided in said fog spray opening for creating a fog pattern.

3. A firefighting nozzle according to claim 1, wherein said hydraulic control means comprises:

a) an interior housing carried within said nozzle body, said interior housing defining a hydraulic chamber for receiving a third portion of said liquid, said valve body being mounted for movement within said hydraulic chamber and having a surface subject to forward pressure from said third portion of said liquid;

b) inlet means in said interior housing for admitting said third portion of said liquid into said hydraulic chamber;

c) outlet means in said interior housing for discharging said third portion of said liquid from said hydraulic chamber; and d) outlet control means for selectively varying flow through said outlet means to control said hydraulic pressure.

4. A firefighting nozzle according to claim 3, wherein said outlet control means comprises:

a) a metering valve mounted for translation from a first position closing said outlet means to a second position allowing maximum flow through said outlet means; and b) manually actuable trigger means coupled to said metering valve for selectively moving said metering valve from said first position to said second position and any position therebetween.

5. A firefighting nozzle according to claim 4, wherein said outlet control means further comprises biasing means for normally urging said metering valve to said first position, shutting off said solid stream automatically upon release of said trigger means.

6. A firefighting nozzle according to claim 1, further comprising fog control means disposed within said fog spray opening for varying said intensity.

7. A firefighting nozzle according to claim 6, wherein said fog control means comprises:

a) an annular valve body mounted for axial movement within said nozzle body, said annular valve body having a tapered surface;

b) an annular valve seat formed in said fog spray opening, said annular valve seat including a surface configured to mate with said tapered surface of said annular valve body; and c) actuation means for moving said annular valve body relative said annular valve seat to vary said intensity.

8. A firefighting nozzle according to claim 6, further comprising shaping means carried on said nozzle body proximate said fog spray opening for selectively varying said included angle.

9. A firefighting nozzle comprising a hollow nozzle body having:

a) an open inlet end for receiving a liquid from a hose;

b) an outlet end including i) a jet orifice for discharging a first portion of said liquid in a form of a circular solid stream having a variable diameter, and ii) a fog spray opening for discharging a second portion of said liquid in a form of a conical stream of evenly distributed droplets, said conical stream having a variable intensity;

c) jet control means disposed within said jet orifice for selectively varying said diameter;

d) fog control means, disposed within said fog spray opening and operable independently of said jet control means, for selectively varying said intensity;

e) front grip means depending from said nozzle body proximate said outlet end; and f) rear grip means depending from said nozzle body proximate said inlet end;

wherein said jet control means comprises i) first valve means carried in said jet orifice, ii) first actuator means carried on said rear grip means for controlling movement of said first valve means, and iii) hydraulic control means, operably coupled to said first actuator means, for utilizing hydraulic pressure to operate said first valve means, and said fog control means comprises i) second valve means carried in said fog spray opening, and ii) second actuator means carried on said front grip means for controlling movement of said second valve means.

10. A firefighting nozzle according to claim 9, further comprising a plurality of inwardly and forwardly extending projections provided in said fog spray opening for creating a fog pattern.

11. A firefighting nozzle according to claim 9, wherein said first actuator means comprises a manually actuable trigger moveably coupled to said rear grip means.

12. A firefighting nozzle according to claim 9, wherein said second actuator means comprises a rotatable handle secured to said front grip means.

13. A firefighting nozzle comprising a hollow nozzle body having:

a) an open inlet end for receiving a liquid from a hose;

b) an outlet end including i) a jet orifice for discharging a first portion of said liquid in a form of a circular solid stream having a variable diameter, and ii) a fog spray opening for discharging a second portion of said liquid in a form of a conical stream of evenly distributed droplets, said conical stream having a variable intensity;

c) jet control means disposed within said jet orifice for selectively varying said diameter;

d) fog control means, disposed within said fog spray opening and operable independently of said jet control means, for selectively varying said intensity;

e) front grip means depending from said nozzle body proximate said outlet end; and f) rear grip means depending from said nozzle body proximate said inlet end;

wherein said jet control means comprises i) first valve means carried in said jet orifice, and ii) first actuator means carried on said rear grip means for controlling movement of said first valve means; and said fog control means comprises i) second valve means carried in said fog spray opening, ii) second actuator means carried on said front grip means for controlling movement of said second valve means, and iii) hydraulic control means operably coupled to said second actuator means for utilizing hydraulic pressure to operate said second valve means.

14. A firefighting nozzle comprising a hollow nozzle body having:

a) an open inlet end for receiving a liquid from a hose;

b) an outlet end including i) a jet orifice for discharging a first portion of said liquid in a form of a circular solid stream having a variable diameter, and ii) a fog spray opening for discharging a second portion of said liquid in a form of a conical stream of evenly distributed droplets, said stream having a variable intensity;

c) front grip means depending from said nozzle body proximate said outlet end;

d) rear grip means depending from said nozzle body proximate said inlet end;

e) jet control means disposed within said jet orifice for selectively varying said diameter, said jet control means including i) first valve means carried in said jet orifice, and ii) first actuator means carried on said rear grip means for controlling movement of said first valve means;

f) fog control means, disposed within said fog spray opening and operable independently of said jet control means, for selectively varying said intensity of said conical stream, said fog control means including i) second valve means carried in said fog spray opening, and ii) second actuator means carried on said front grip means for controlling movement of said second valve means; and g) bottom guard means extending between said front and rear grip means for preventing accidental activation of said first actuator means.

15. A firefighting nozzle comprising a hollow nozzle body having:

a) an open inlet end for receiving a liquid from a hose;

b) an outlet end including i) a jet orifice for discharging a first portion of said liquid in a form of a circular solid stream having a diameter, and ii) an annular fog spray opening surrounding said jet orifice for discharging a second portion of said liquid in a form of a conical stream of evenly distributed droplets, said conical stream having a variable intensity; and c) fog control means disposed within said fog spray opening for varying said intensity, said fog control means including i) an annular valve body mounted for axial movement within said nozzle body, said annular valve body having a tapered surface, ii) an annular valve seat formed in said fog spray opening, said annular valve seat including a surface configured to mate with said tapered surface of said annular valve body, and iii) hydraulic control means utilizing hydraulic pressure for moving said valve body relative said valve seat to vary said intensity.

16. A firefighting nozzle according to claim 15, wherein said hydraulic control means comprises:

a) an interior housing carried within said nozzle body, said interior housing defining a hydraulic chamber for receiving another portion of said liquid, said annular valve body being mounted for movement within said hydraulic chamber and having a surface subject to forward pressure from said other portion of said liquid;

b) inlet means for admitting said other portion of said liquid into said hydraulic chamber;

c) outlet means for discharging said other portion of said liquid from said hydraulic chamber; and d) outlet control means for selectively varying flow through said outlet means to control said hydraulic pressure.

17. A firefighting nozzle according to claim 16, wherein said outlet control means comprises:

a) a valve mounted for longitudinal translation from a first position closing said outlet means to a second position allowing maximum flow through said outlet means;

b) a rotatable actuator secured to said nozzle body; and c) means cooperating with said valve and said actuator for converting rotational movement of said actuator to said longitudinal translation of said valve.

18. A firefighting nozzle comprising a hollow nozzle body having:

a) an open inlet end for receiving a liquid form a hose;

b) an outlet end including i) a jet orifice for discharging a first portion of said liquid in a form of a circular solid stream having a variable diameter, and ii) a fog spray opening for discharging a second portion of said liquid in a form of a conical stream of evenly distributed droplets, said conical stream having a variable intensity;

c) jet control means disposed within said jet orifice for selectively varying said diameter;

d) fog control means, disposed within said fog spray opening, for selectively varying said intensity; and e) hydraulic control means utilizing hydraulic pressure to actuate said jet control means and said fog control means independently of one another.

* * * * *